United States Patent [19]

Uchida

[11] Patent Number: 4,505,307

[45] Date of Patent: Mar. 19, 1985

[54] METHOD OF POURING MOLTEN METAL INTO INJECTION SLEEVES OF DIE CAST MACHINES

[75] Inventor: Masashi Uchida, Ube, Japan

[73] Assignee: Ube Industries, Ltd., Yamaguchi, Japan

[21] Appl. No.: 508,810

[22] Filed: Jun. 28, 1983

[30] Foreign Application Priority Data

Jun. 29, 1982 [JP] Japan ..... 57-110811
Feb. 22, 1983 [JP] Japan ..... 58-26971

[51] Int. Cl.[3] ..... B65B 3/04; B22D 17/08; B22D 17/30; B22D 17/32

[52] U.S. Cl. ..... 141/1; 141/95; 141/284; 164/136; 164/457

[58] Field of Search ..... 164/113, 457, 155, 156, 164/133, 136, 312, 335; 222/602, 590; 141/1, 95, 284

[56] References Cited

U.S. PATENT DOCUMENTS 1,375,589 4/1921 Hosack ..... 164/335 X
2,741,814 4/1956 Hazlett ..... 164/136 X
3,157,923 11/1964 Hodler ..... 164/156 X
3,404,725 10/1968 Kapun ..... 164/156
4,146,081 3/1979 Reis ..... 164/136 X

FOREIGN PATENT DOCUMENTS 38-4306 4/1963 Japan ..... 164/136

*Primary Examiner*—Nicholas P. Godici
*Assistant Examiner*—J. Reed Batten, Jr.
*Attorney, Agent, or Firm*—Blakely, Sokoloff, Taylor & Zafman

[57] ABSTRACT

In a die cast machine of the type wherein molten metal in a metal melting furnace is poured into an injection sleeve and the molten metal in the injection sleeve is injected into a die, a ladle having a molten metal discharge port is used to receive the molten metal from the furnace. The lower portion of the ladle is inserted into the injection sleeve. Then the port is opened to discharge the molten metal in the ladle into the injection sleeve and the ladle is continuously raised at such a speed that the level of the molten metal in the sleeve is always maintained at a level near the port.

11 Claims, 18 Drawing Figures

METHOD OF POURING MOLTEN METAL INTO INJECTION SLEEVES OF DIE CAST MACHINES

BACKGROUND OF THE INVENTION

This invention relates to a method of pouring molten metal into an injection sleeve of a die cast machine.

When pouring molten metal of aluminum alloy, for example, into an injection sleeve of a vertical die cast machine according to a prior art method, a ladle 1 having a configuration as shown in FIG. 1 was used and the ladle was bowed at a position above an injection sleeve 2 in a waiting position for reception of the teemed molten metal. In this method, the height between the pouring port 1*a* of the ladle 1 and the upper surface of the plunger tip 3 onto which the molten metal is teemed is relatively large so that as the molten metal is teemed into the injection sleeve 2, a whirling motion occurs in the teemed molten metal. As a consequence, the molten metal is stirred and the chance of contacting air increases so that the quantity of aluminum oxide increases. Moreover, the quantity of air entrained in the molten metal increases and the temperature of the molten metal lowers more or less, thereby forming unsatisfactory cast products.

SUMMARY OF THE INVENTION

Accordingly, it is an object of this invention to provide an improved method of pouring molten metal in a ladle into an injection sleeve without contacting the molten metal with air and without entraining air into the molten metal.

Another object of this invention is to provide a method of pouring molten metal in the ladle into an injection sleeve, in which the ladle is raised according to a predetermined speed pattern.

According to this invention there is provided a method of pouring molten metal for a die cast machine including a ladle having a molten metal discharge port at the bottom and an injection sleeve, characterized in that the method comprises the steps of pouring molten metal into the ladle while the port is closed; inserting the bottom portion of the ladle into the injection sleeve; opening the port to commence to discharge the molten metal in the ladle into the injection sleeve, continuously raising the ladle while continuously discharging the molten metal therein into the injection sleeve; and raising the ladle out of the injection sleeve when the level of the molten metal in the injection sleeve rises to a level higher than the port.

Advantageously, the ladle is raised according to a predetermined speed pattern. Sensors for detecting the level of the molten metal inside or outside of the ladle are provided for controlling the raising of the ladle.

DESCRIPTION OF THE PREFERRED EMBODIMENTS

Figure 1:
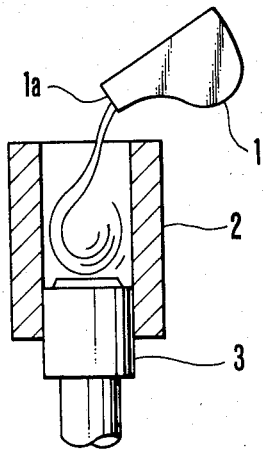
FIG.1 PRIOR ART
FIG. 1 is a sectional view showing a prior art method of pouring molten metal into an injection sleeve of a vertical type die cast machine.

The outline of a vertical type die cast machine and its operation will first be described with reference to FIG. 2. The die cast machine comprises a stationary board 10, columns 11, a movable die 12, a stationary die 13, an injection unit 14 including an injection sleeve 15, an injection plunger 16, an injection cylinder 17, and a molten metal pouring ladle 18. The upper end of the injection plunger 16 terminates in a plunger tip 16*a* slidably received in the injection sleeve 15, while the lower end is connected to the piston rod 17*a* of the injection cylinder 17.

Interposed between the stationary board 10 and the stationary die 13 is a movable bolster 20 having an opening 19 at its center through which the injection sleeve 15 moves in the vertical direction. A horizontal notch 21 extends from the central portion of the stationary board 10 toward one side thereof. The injection cylinder 15 is positioned in the notch 21 to be movable laterally. The notch 21 may be a laterally elongated notch opened in one side surface of the stationary board 10 or may be a slot not opened in the one side surface.

The injection sleeve 15 below the stationary die engages or disengages the opening 19 of the bolster 20 in the vertical direction, the stationary die 13 being secured to the stationary board 10. Accordingly, the injection sleeve 15 separated from the lower surface of the stationary die 13 can be moved laterally to a pouring position shown by dotted lines while the injection plunger 16 is being inserted in the injection sleeve 15.

The central portion of the lower surface of the stationary die 13 and the upper surface of the injection sleeve 15 are dowelled. The lower end of the injection sleeve 15 is integral with a block 24 that forms a cylinder 23 so that the injection sleeve 15 can be moved in the vertical direction by rams 25 secured to the upper end of the injection cylinder 17. The cylinder 23 and rams 25 are parallel with the piston rod 17*a* of the injection cylinder 17. The lower end of the block 24 slidably receives the piston rod 17*a*. The injection cylinder 17 is pivotably supported by a shaft 26 and is inclined by a cylinder 27. The leftward swinging of the cylinder 17 is limited by a stop member 28.

While the injection plunger 16 is being inserted in the injection sleeve 15, the injection sleeve 15 is inclined to a position shown by dot and dash lines. Under this state, the molten metal is poured into the injection sleeve 15 from the ladle 18. Then, the tilting cylinder 27 is operated to rotate the injection unit 14 about shaft 26 to the solid line position. Further, the cylinder 23 and the piston rod 17*a* are operated simultaneously to raise the injection sleeve 15 and the injection plunger 16 to a position E, thereby urging the injection sleeve 15 against the lower surface of the stationary die 13.

Before this operation, the die clamping operation has already been completed and immediately after urging the injection sleeve 15 to the lower surface of the stationary die 13, pressurized oil is admitted into the injection cylinder 17 to inject molten metal. When the injected product cools after completion of the injection, the movable die 12 is opened to remove the product. In synchronism with the die opening operation, the injection plunger 16 is lowered and the injection sleeve 15 is simultaneously lowered by the operation of the cylinder 23 when both injection plunger 16 and the injection sleeve 15 descend, and the tilting cylinder 27 is operated to move the injection unit 14 to position C, thus completing one cycle of operation.

Figure 2:
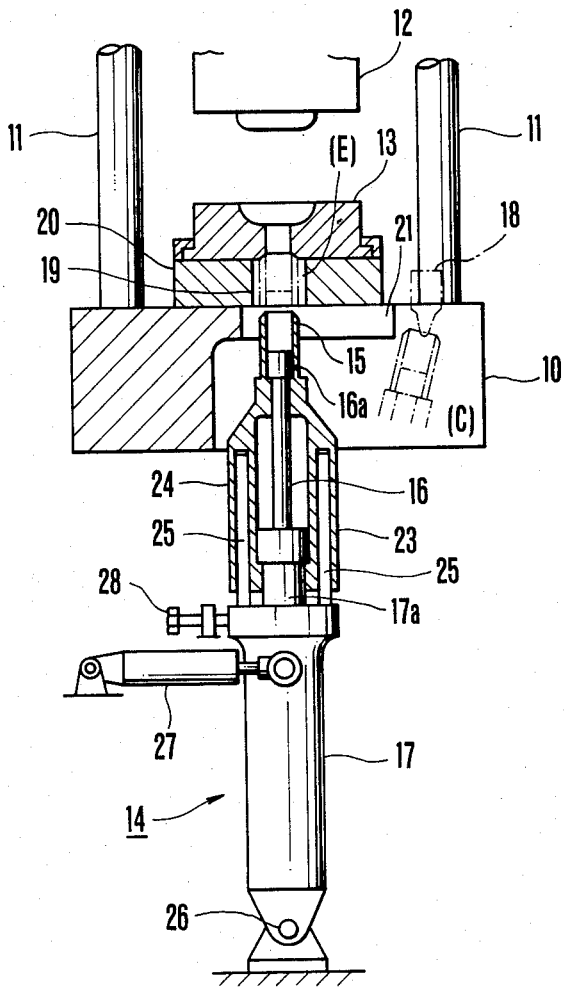
FIG. 2 is a longitudinal sectional view showing a vertical type die cast machine in which the method of pouring molten metal of this invention is used.

Although in the case shown in FIG. 2, after lowering the injection sleeve 15, the injection unit 14 is tilted about shaft 26 and then moved laterally, the injection unit may be moved in the horizontal direction without tilting.

Figure 3:
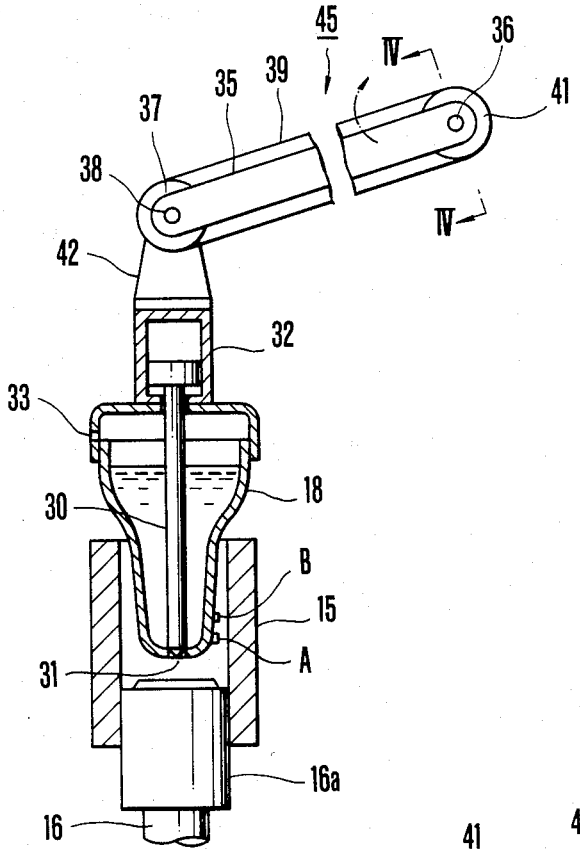
FIG. 3 is a longitudinal sectional view showing one example of a ladle and an injection sleeve.
Figure 4:
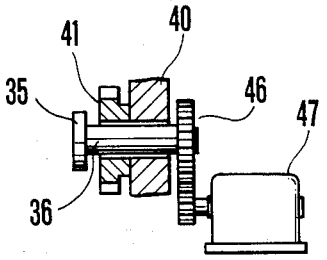
FIG. 4 is a sectional view taken along line IV—IV in FIG. 3.

FIGS. 3 and 4 show such a modification, in which the lower portion of the ladle 18 is decreased in diameter so that it can be inserted into the injection sleeve 15 and is formed with a molten metal pouring port 31 opened and closed by a valve rod 30. In the embodiment shown in FIG. 3, a pair of vertically spaced sensors A and B for detecting the surface or level of the molten metal poured in the injection sleeve 15 are mounted on the outer surface of the lower portion at positions slightly above the port 31. On the upper surface of the ladle 18 is secured a piston cylinder assembly 32 for vertically moving the valve rod 30, and an air port 33 is formed through the upper portion of the ladle 18.

There are also provided a link 35 vertically swingable about a shaft 36, a chain wheel 37 rotatably mounted on a shaft 38 at the front end of the link 35, another chain wheel 41 secured to a frame 40 (FIG. 4), an endless chain 39 passing about chain wheels 37 and 41, and a bracket 42 integrally interconnecting the chain wheel 37 and the cylinder 32. These elements constitute a ladle conveying device 45. The shaft 36 is driven by an electric motor 47 through a reduction gearing 46.

Figure 5:
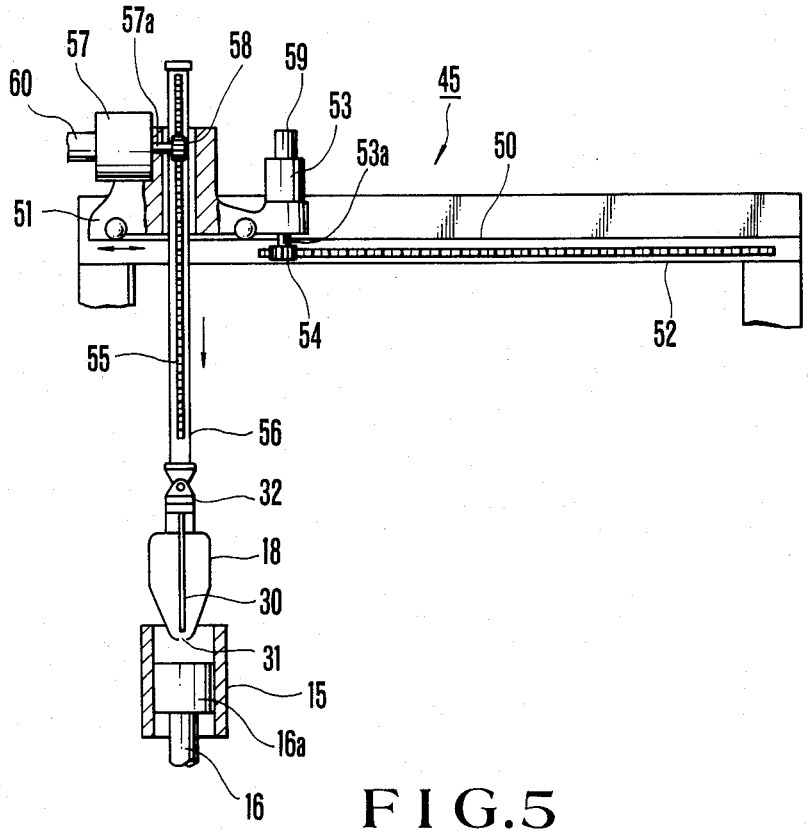
FIG. 5 is a side view, partly in section, showing another example of a ladle conveying device.

It should be understood that the ladle conveying device is not limited to that shown in FIGS. 3 and 4 and that many modifications are possible. For example, it can be constructed as shown in FIG. 5. This modified ladle conveying device 45 comprises a carriage 51 running along horizontal rails 50, an elongated rack 52 extending along the rails 50, a running motor 53 mounted on the carriage 51 for driving a pinion 54 meshing with the rack 52 and secured to the shaft 53*a* of the motor 53, a vertical elongated lever 56 formed with a rack 55 and adapted to interconnect the carriage 51 and the cylinder 32, a ladle elevating motor 57 mounted on the carriage 51, the shaft 57*a* of the motor 57 driving a pinion 58 meshing with the rack 55, a running position detector 59 and a vertical position detector 60 in the form of rotary encoders, for example.

Figure 6:
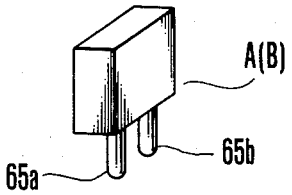
FIG. 6 is a perspective view of a sensor utilized in this embodiment.

The pair of sensors A and B are secured to the ladle 18 via electric insulators and each has as shown in FIG. 6 a pair of electrode rods 65*a* and 65*b* made of carbon, for example, so that as electroconductive molten metal contact these electrode rods 65*a* and 65*b*, these rods are short circuited to detect the molten metal. The sensors may be substituted by thermocouples. The signals detected by these sensors A and B are used to drive the ladle conveying device 45 so as to intermittently pull up the ladle 18 as will be described later.

Instead of providing a pair of electrode rods for respective sensors A and B, a single electrode rod can be provided which is used to close or open an electric circuit between it and the ladle 18 or the injection sleeve 15.

Figure 7:
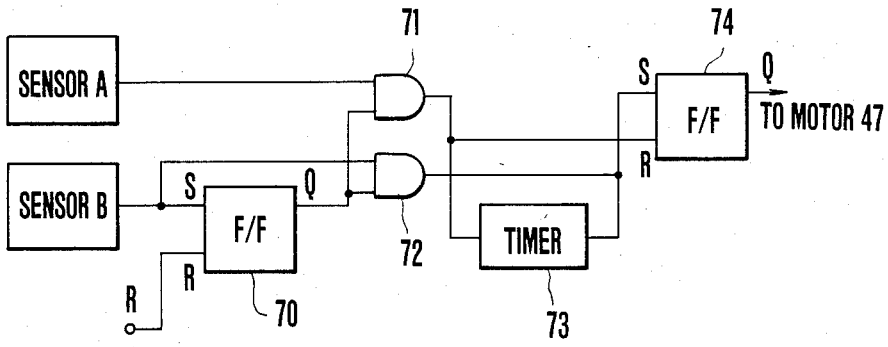
FIG. 7 is a block diagram showing an electric circuit for driving the ladle conveying device.

The ladle conveying device 45 is controlled by a circuit shown in FIG. 7. The sensor A is positioned on the outer surface of the lower end of the ladle 18 at a position lower than sensor B. When the molten metal does not contact the sensor A, it produces a signal, whereas sensor B produces a signal when the molten metal comes to contact it. A flip-flop circuit 70 produces an output at its output Q when a set signal is supplied to its set input terminal S while it does not produce any output when a reset signal is applied to its reset terminal R. The output from the output terminal Q is continuously produced even when the set input signal disappears. In the same manner, even after the reset input signal disappears, no output condition of the output terminal Q continues. The Q output signal of the flip-flop circuit 70 is applied to one input terminal of respective AND gate circuits 71 and 72, and the output signals of sensors A and B are supplied to the other input terminal of each of the AND gate circuits 71 and 72. The operating time of a timer 73 is set to be longer than an interval between an instant at which the surface of the molten metal poured into the injection sleeve 15 comes to contact with sensor A and an instant at which the surface of the molten metal comes to contact with the sensor B. This interval is usually 1–2 seconds. The output of the AND gate circuit 71 is applied to the reset terminal R of a flip-flop circuit 74, the output signal of the timer 73 is supplied to the set terminal S of the flip-flop circuit 74, and the Q output signal of the flip-flop circuit 74 is supplied to motor 47.

The method of pouring molten metal with the pouring device described above will now be described. At first, the lower portion of the ladle 18 is immersed into a bath of molten metal to position its port 31 below the surface oxide film of the molten metal. Then the piston-cylinder assembly 32 is operated to raise the valve rod 30 to admit a desired quantity of the molten metal into the ladle 18. The quantity of the poured molten metal is determined by the relative vertical position of the ladle 18 with respect to the surface of the molten metal in a metal melting bath. The quantity of the poured molten metal is determined by stopping the ladle at a predetermined position, such position being controlled by a well known electrode rod, not shown, secured to the ladle 18.

When the desired quantity of the molten metal enters into the ladle 18, the piston cylinder assembly 32 is actuated to descend the valve rod 30 for closing the pouring port 31. Then the ladle conveying device 45 is operated to move the ladle 18 to a position above the injection sleeve 15 at the waiting position. Then, as shown in FIG. 3, the lower portion of the ladle 18 is inserted into the injection sleeve 15 to bring the pouring port 31 to a position close to the upper surface of the plunger tip 16*a*. The distance between the pouring port 31 at the lower end of the ladle 18 and the plunger tip 16*a* is different depending upon the depth of the molten metal within the ladle 18 and the area of the port 31 but this distance is selected to be small, measuring about 5–10 mm, for example, which is necessary to prevent gas from being entrained into the molten metal when the molten metal flows out.

Figure 8A:
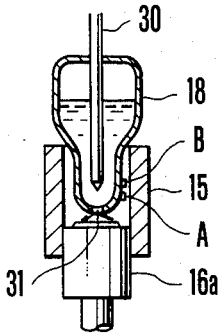
FIGS. 8*a*, 8*b* and 8*c* are fragmentary views useful to explain the operating steps of the method of this invention.

Then the piston cylinder assembly 32 is actuated to raise the valve rod 30 for opening the pouring port 31, thus discharging the molten metal in the ladle 18 into the injection sleeve 15. This state is shown in FIG. 8*a*. When the ladle 18 is kept at this state, the molten metal is sequentially discharged through the port 31. As a consequence, the level of the molten metal in the injection sleeve 15 rises gradually without being stirred. Finally, the level of the molten metal in the injection sleeve rises above the pouring port 31. As the level of the molten metal rises beyond the port 31 about 5–10 mm, for example, the molten metal comes to contact with sensor A. Consequently, the sensor A stops sending the control signal to the AND gate circuit 71 shown in FIG. 7.

Figure 8B:
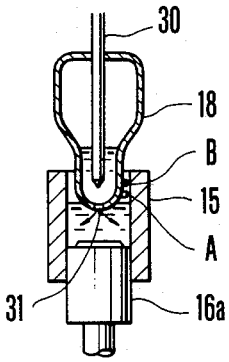

Thus, the sensor A continuously sends out the control signal before contacted by the molten metal in the injection sleeve 15. However, since the flip-flop circuit 70 has been reset by the resetting signal applied to its reset terminal R, the flip-flop circuit 70 does not supply its output signal to the AND gate circuit 71 so that this AND gate circuit does not send out an output signal. Accordingly, timer 73 will not operate at the commencement of the discharge of the molten metal but will begin to operate only when the sensor B first detects the molten metal in the sleeve and thereafter the sensor A detects the molten metal. When the molten metal in the injection cylinder 15 reaches the sensor B after passing by the sensor A, the sensor B sends a control signal to the flip-flop circuit 70 to cause it to send out an output signal from its Q terminal. This output signal enables the AND gate circuits 71 and 72. Consequently, the output of AND gate circuit 72 is applied to the set terminal S of the flip-flop circuit 74 to cause it to produce a Q output which is used to drive motor 47 for quickly raising the ladle conveying device 45. As the ladle conveying device 45 is raised, the ladle 18 is also raised as shown in FIG. 8*b* with the result that the level of the molten metal discharged in the injection sleeve 15 becomes lower than the sensor A, that is, the molten metal does not contact this sensor A so that the sensor A sends again the control signal to one input of AND gate circuit 71. Before this time the AND gate circuit 71 is disabled because it is supplied only with the output of the flip-flop circuit 70. Now the AND gate circuit 71 is enabled to supply its output to the timer 73 and to the reset terminal R of flip-flop circuit 74. Consequently, the flip-flop circuit 74 stops producing an output signal thereby stopping the motor 47. Accordingly, the ladle conveying device 45 is stopped to hold the ladle 18 at the stopped position. Even when the ladle 18 is stopped, the molten metal therein is discharged into the injection sleeve 15 so that the level of the molten metal therein continues to rise and the molten metal sequentially comes into contact with sensors A and B. Consequently, as described above, the ladle conveying device 45 is operated again to raise ladle 18 and then stopped. In this manner, the ladle 18 is intermittently raised such that the level of the molten metal discharged in the injection sleeve 15 will always lie between sensors A and B so as to constantly discharge the molten metal in the ladle 18 into the injection sleeve 15.

In response to the output of the AND gate circuit 71, the timer 73 starts its timing action. However, the interval in which the molten metal reaches sensor A and then sensor B is extremely short and shorter than the set time of the timer 73 so that the timer 73 will not time up to send a signal to the set terminal S of flip-flop circuit 74. As the molten metal discharges out of the ladle 18, the difference in the levels of the molten metal in the ladle 18 and the injection sleeve 15 decreases gradually so that the discharge speed of the molten metal through the port 31 gradually decreases. As a consequence, the interval in which the molten metal in the injection sleeve 15 reaches sensor A and then sensor B becomes shorter. Thus, the height of rise of the ladle 18 gradually decreases.

Figure 8C:
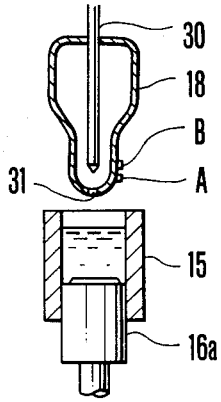

During the latter half of the rise of the ladle, the head of the molten metal becomes substantially zero and the speed of the molten metal flowing out through the port 31 is greatly decreased so that the interval in which the molten metal in the injection sleeve 15 contacts the sensor A and then the sensor B becomes longer. When this interval becomes longer than the set time of timer 73, the timer judges that the discharge of the molten metal from the ladle has completed and sends a signal to the set terminal S of the flip-flop circuit 74. Accordingly, the flip-flop circuit 74 produces a Q output to operate motor 47 and consequently to operate the ladle conveying device 45 for raising the ladle 18 above the injection sleeve 15. A small quantity of the molten metal remaining in the ladle 18 is discharged quickly through port 31 to complete pouring of the molten metal into the injection sleeve 15. FIG. 8*c* shows this state.

The ladle raising speed between the commencement of the discharge of the molten metal and the latter half of the ladle raise is changed suitably according to the area of the port 31, the quantity of the molten metal, and the spacing between sensors A and B. When the speed of raising the ladle 18 is increased as the head becomes small, it is possible to quickly discharge a small quantity of the remaining molten metal, thus proportionally decreasing the molten metal pouring time. At this time, since the head of molten metal is small, substantially no air would be entrained in the molten metal. When the pouring of the molten metal into the injection sleeve 15 completes, as described above, the injection unit 14 is moved to the injection position shown by solid lines in FIG. 2 for performing injection casting.

Although in the foregoing embodiment, the invention was applied to a vertical type die cast machine, it will be clear that the method of this invention is also applicable to a horizontal type die cast machine, in which case, the molten metal pouring port 31 at the lower end of the ladle 18 is positioned immediately above the inner bottom surface of the injection sleeve.

Figure 9:
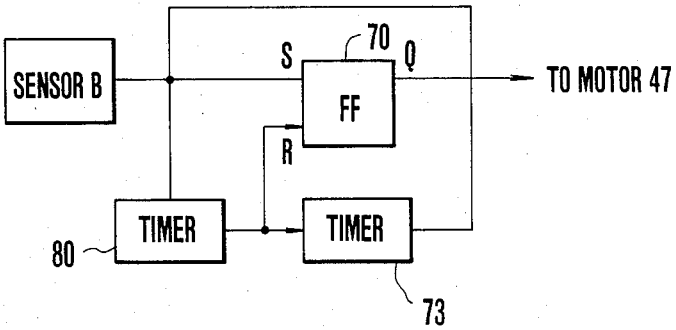
FIG. 9 is a block diagram of an electric circuit utilizing only one sensor.

The pair of sensors A and B can be substituted by a single sensor. In such a modification, the control circuit shown in FIG. 9 is designed such that a single sensor B which produces a control signal when contacted by the molten metal is used.

In this case, since a single sensor is used, it is necessary to use an additional timer 80 having a shorter set time than timer 73. Then the ladle conveying device 45 is operated for a definite time set in the timer 80 each time the sensor B is contacted by the molten metal. Thus, the ladle 18 is intermittently raised for a definite distance irrespective of the rising speed of the ladle 18. When the head becomes small and the time until the sensor B detects the molten metal becomes longer than the set time of the timer 73, the timer 73 times up to send a signal to the set terminal S of the flip-flop circuit 70, whereby the motor 47 is operated to pull the ladle 18 out of the injection sleeve 15.

The motor 47 for raising the ladle conveying device 45 may be substituted by an oil pressure cylinder.

As described above, according to this embodiment, since a sensor adapted to detect the level of the molten metal discharged in the injection sleeve is provided at the lower end of the ladle and since the molten metal in the ladle is discharged while the ladle is intermittently raised by a control signal produced by the sensor, there is no fear of whirling of the molten metal in the injection sleeve at the time of pouring the molten metal. Furthermore, since the molten metal is not exposed to a large quantity of air, and since air is not entrained in the molten metal, any appreciable quantity of aluminum oxide will not be formed and the temperature lowering of the molten metal can also be suppressed. For this reason, high quality cast products free from gross porosity can be obtained.

When the quantity of the molten metal remaining in the ladle becomes small, the ladle is raised out of the injection sleeve by the timer regardless of the detection of the level of the molten metal by the sensor so that the molten metal can be discharged quickly. Otherwise, it takes a long time to discharge the molten metal near the end of pouring the same thus decreasing the pouring time.

Furthermore when pouring the molten metal in the metal melting bath into the ladle, as it is possible to immerse the port at the bottom of the ladle below the oxide layer on the surface of the molten metal in the bath and then open the port to admit the molten metal, it is possible to prevent the oxide layer from entering into the ladle.

Although in the foregoing embodiment one or two sensors were provided for the lower portion of the ladle 18, molten metal can be poured into the injection plunger 15 in the same manner without using the sensor.

In this case, the lower portion of the ladle 18 is immersed in molten metal in the metal melting furnace to a depth below the oxide film on the surface of the molten metal. Then the piston cylinder 32 is operated to raise the valve rod 30 and to admit a desired quantity of molten metal into the ladle 18 through the port 31 at the lower end thereof. The quantity of the molten metal in the ladle 18 is determined by the position of the ladle with respect to the surface of the molten metal in the metal melting furnace or bath. The ladle can be maintained at the desired position by the electrode rod described above.

When a desired quantity of the molten metal is admitted into the ladle 18, the piston cylinder 32 is operated to close the port 31 by valve rod 30. Then the ladle is moved by the ladle conveying device 45 and its lower end is inserted into the injection sleeve 15 at the waiting position.

Then the cylinder 32 is operated to raise the valve rod 30 to open the opening 31 whereby the molten metal in the ladle 18 begins to discharge into the injection sleeve as shown in FIG. 8*a*. So long as the ladle 18 is maintained in this state, the level of the molten metal in the injection sleeve is raised gradually by the molten metal discharging from the port 31, so that the surface of the molten metal will not be stirred. Meanwhile the levels of the molten metal in the ladle and the injection sleeve becomes substantially equal. Thereafter, the ladle 18 is raised to the outside of the injection sleeve by the ladle conveying device, as shown in FIG. 8*c*, whereby the molten metal remaining in the ladle is completely discharged. The molten metal in the injection sleeve is injected into the die cavity in the same manner as described above.

Instead of discharging the molten metal in the ladle into the injection sleeve in a manner as described above, the raising of the ladle may be modified as follows. Thus, the ladle is raised such that its pouring port is always maintained near the level of the molten metal in the injection sleeve. Namely, while raising the ladle, the pouring port of the ladle is maintained slightly above or below the level of the molten metal in the injection sleeve, thus preventing unwanted whirling and contact of the molten metal with air.

Figures 10A, 10B, 10C:
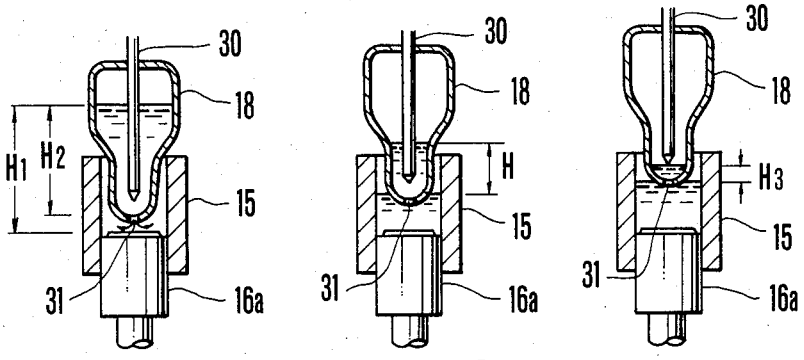
FIGS. 10*a*, 10*b* and 10*c* are sectional views showing the variation in the heads of the molten metal in the ladle.

FIGS. 10*a*, 10*b* and 10*c* are sectional views similar to FIGS. 8*a*, 8*b* and 8*c* except that heads of the molten metal at successive steps of raising the ladle 18 are shown.

In this embodiment too, the ladle is gradually raised such that the level of the molten metal in the injection sleeve 15 will always be slightly higher than the port 31. In addition, the raising speed V of the ladle follows a predetermined curve selected such that as head or the difference H between the levels of the molten metal in the ladle and the injection sleeve becomes small, the speed V of raising the ladle also decreases as shown in FIG. 11.

During the latter stage of raising the ladle the level difference H becomes small, that is, the head of the molten metal remaining in the ladle decreases so that it takes a relatively long time to completely discharge the remaining molten metal out of the ladle. For this reason, it is advantageous to raise the ladle during the latter stage at a speed faster than that of the predetermined curve for the purpose of quickly discharging the remaining molten metal.

The ladle raising speed can be automatically controlled by a suitable control circuit and the measurement of the level of the molten metal in the injection sleeve can be made by a sensor described above or an electrode or by using a suitable timer.

Figure 11:
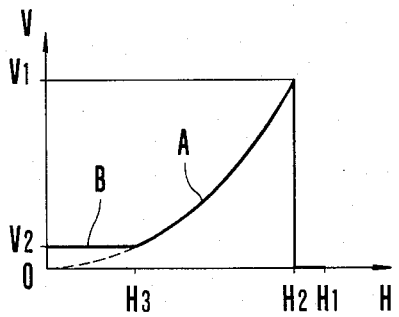
FIG. 11 shows a ladle raising speed curve.

As shown in FIG. 11, during an interval between the commencement of the discharge of the molten metal in the ladle into the injection sleeve (at this time the head is $H_1$) and an instant at which the level of the molten metal in the injection sleeve reaches a position slightly higher than the port 31 (at this time the head is $H_2$), the ladle 18 is raised at a very small speed or the ladle is maintained standstill. Thereafter, the ladle is raised in accordance with a curve A according to which the ladle is raised at a relatively high speed $V_1$ and then the speed V is gradually decreased as the ladle is raised further. After the head H has decreased to a small value $H_3$, for example, 10 to 20 mm, the ladle is raised at a small speed V2 along curve B.

After the head has been decreased to a small value $H_3$ as shown in FIG. 10*c*, the ladle raising speed may be maintained at a constant value V2 (curve B) or slightly increased or decreased as the head H decreases with the raising of the ladle.

Near the final stage of the discharge, the quantity or head of the molten metal remaining in the ladle decreases so that the discharge speed of the molten metal decreases. Then the ladle is quickly raised to rapidly discharge the remaining molten metal. At this time since the head is small, any appreciable quantity of air would not be entrained in the discharged molten metal.

Figures 12A, 12B, 12C:
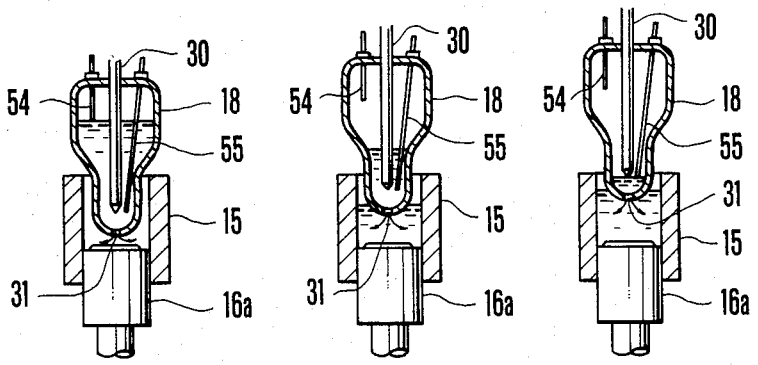
FIGS. 12*a*, 12*b* and 12*c* are sectional views showing a ladle provided with electrodes for detecting the level of the molten metal in the ladle.

FIGS. 12*a*, 12*b* and 12*c* show sectional views of a ladle utilizing a pair of detection electrodes 54 and 55 for detecting the level or head of the molten metal contained in the ladle 18. The detection electrodes 54 and 55 are electrically insulated from the ladle and connected to a control circuit, not shown, that raises the ladle. The lower end of the electrode 54 is positioned such that it detects the level of the molten metal in the ladle when the level of the molten metal discharged into the injection sleeve 15 rises to a level slightly above the pouring port 31, whereas the lower end of the electrode 55 is positioned close to the port 31 so as to detect the level of a small quantity of the molten metal remaining in the ladle, in other words, to raise the ladle at a higher speed. When the lower end of the electrode 55 is positioned very close to the port 31 it is possible to detect the fact that the molten metal in the ladle has been substantially completely discharged.

The electrodes 54 and 55 may be substituted by any other sensors that can detect the level of the molten metal in the ladle.

The modified ladle shown in FIGS. 12*a*, 12*b* and 12*c* is operated in the same manner as that shown in FIGS. 8*a*, 8*b* and 8*c* or in the same manner as that shown in FIGS. 10*a*, 10*b* and 10*c*.

It should be understood that the number of the detection electrodes installed in the ladle may be increased to three or more for more adequately controlling the raising speed of the ladle.

What is claimed is:

1. A method of pouring molten metal for a die cast machine including a ladle having a molten metal discharge port at the bottom and an injection sleeve, the method comprising the steps of:

pouring molten metal into said ladle while said port is closed;

inserting a bottom portion of said ladle into a lower portion of said injection sleeve;

opening said port to commence to discharge the molten metal in said ladle into said injection sleeve;

continuously raising said ladle while continuously discharging the molten metal therein into said injection sleeve; and raising said ladle out of said injection sleeve when the level of the molten metal in said injection sleeve rises to a level higher than said port.

2. The method according to claim 1 wherein said ladle is raised out of said injection sleeve when the level of the molten metal discharged into said injection sleeve becomes substantially the same level as that of the molten metal in said ladle which is higher than said port.

3. The method according to claim 1 wherein said ladle is raised according to a predetermined speed curve in which the ladle raising speed is decreased as a head or a difference between the levels of the molten metal in said ladle and said injection sleeve decreases.

4. The method according to claim 3 wherein as the head becomes small, the ladle raising speed is increased so as to rapidly discharge the molten metal remaining in the ladle into said injection sleeve.

5. The method according to claim 1 wherein said ladle is raised such that said port is always maintained near the level of the molten metal in said injection sleeve.

6. The method according to claim 1 wherein at least one molten metal sensor is provided at a lower outer portion of said ladle for producing an electric signal which is used to raise said ladle.

7. The method according to claim 6 wherein said ladle is raised according to said electric signal such that the level of the molten metal in said injection sleeve is always positioned at said sensor.

8. The method according to claim 6 wherein two vertically spaced sensors are provided at the lower outer portion of said ladle, and said ladle is controlled by electric signals produced by said two sensors such that the level of the molten metal in said injection sleeve is maintained between said two sensors.

9. The method according to claim 6 wherein when the level of molten metal discharged into said injection sleeve is not detected by said sensor after lapse of a predetermined time during the latter half of raising the ladle, a timer is operated to raise said ladle.

10. The method according to claim 1 wherein a plurality of molten metal level detection means are disposed in said ladle, one near an upper portion of said ladle and the other near said port, for producing electric signals which are used to raise said ladle.

11. The method according to claim 10 wherein said molten metal level detecting means comprises a plurality of electrodes insulated from said ladle and lower ends of said electrodes terminate at different levels in said ladle.

* * * * *